US005616984A

United States Patent [19]

Guthier

[11] Patent Number: 5,616,984

[45] Date of Patent: Apr. 1, 1997

[54] HIGH WATTAGE LAMP FERRULE AND SOCKET SYSTEM

[75] Inventor: John F. Guthier, Van Nuys, Calif.

[73] Assignee: Xenotech, Inc., North Hollywood, Calif.

[21] Appl. No.: 415,744

[22] Filed: Apr. 3, 1995

Related U.S. Application Data

[63] Continuation of Ser. No. 103,350, Aug. 9, 1993, abandoned.

[51] Int. Cl.[6] ..... H01J 5/50

[52] U.S. Cl. ..... 313/318.04; 313/318.05; 313/318.12; 313/50; 313/51; 439/238; 439/615

[58] Field of Search ..... 313/318.01, 318.04, 313/318.05, 318.12, 49, 50, 51; 439/236, 238, 611, 615

[56] References Cited

U.S. PATENT DOCUMENTS

| | | | |
|---|---|---|---|
| 277,646 | 5/1883 | Weston | 439/611 |
| 860,568 | 7/1907 | Phelps | 439/615 |
| 2,262,629 | 11/1941 | Wright | 439/615 |
| 2,987,696 | 6/1961 | Rudler et al. | 439/615 |
| 3,281,620 | 10/1966 | Miller | 313/318 |
| 5,025,192 | 6/1991 | Okamoto | 313/318 |
| 5,032,759 | 7/1991 | Thiry et al. | 439/611 |
| 5,039,904 | 8/1991 | Kosmatka et al. | 313/49 |
| 5,216,318 | 6/1993 | Van Dulmen et al. | 313/49 |
| 5,216,319 | 6/1993 | Van Heeswijk | 313/51 |

*Primary Examiner*—Louis M. Arana
*Assistant Examiner*—Matthew J. Esserman
*Attorney, Agent, or Firm*—Hawes, Fischer & Dickinson

[57] ABSTRACT

The high current lamp system of the present invention includes a ferrule and socket which are of the same polarity and engage one end of the lamp. The socket is designed to enable the lamp to pivot slightly and permit translation in the direction of the axis of the lamp to facilitate replacement of the lamp. More importantly, the ferrule and socket system of the present invention have been designed to handle the higher power ratings, up to and including the 10,000 watt range.

37 Claims, 2 Drawing Sheets

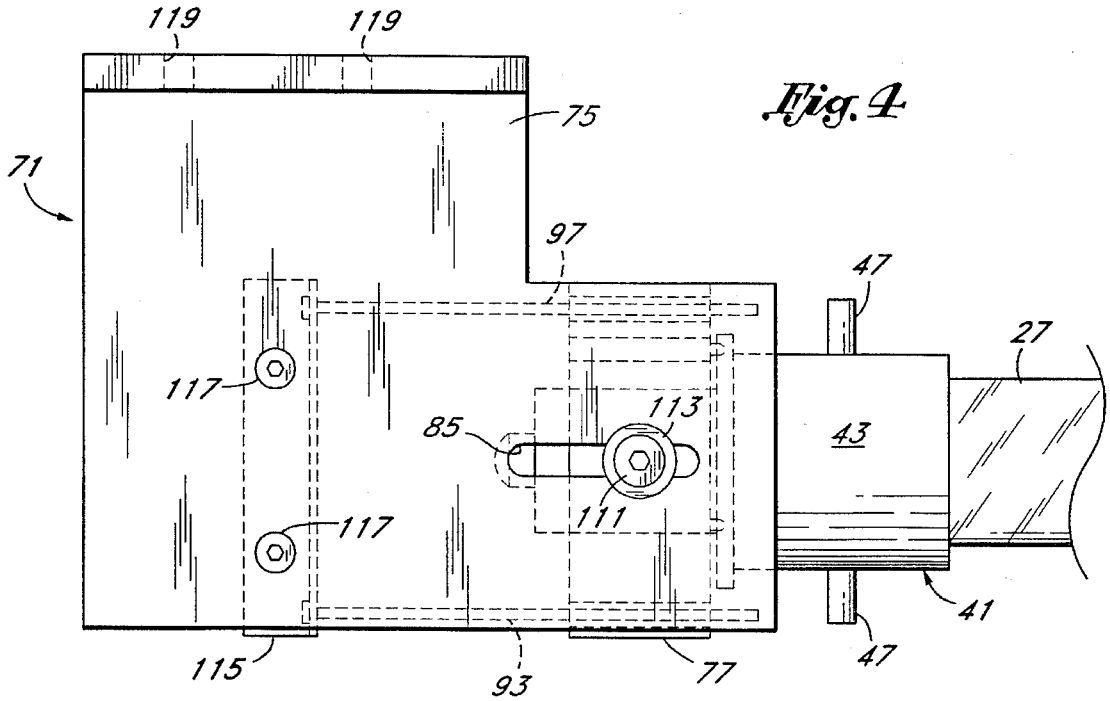
Fig. 4
Fig. 5a
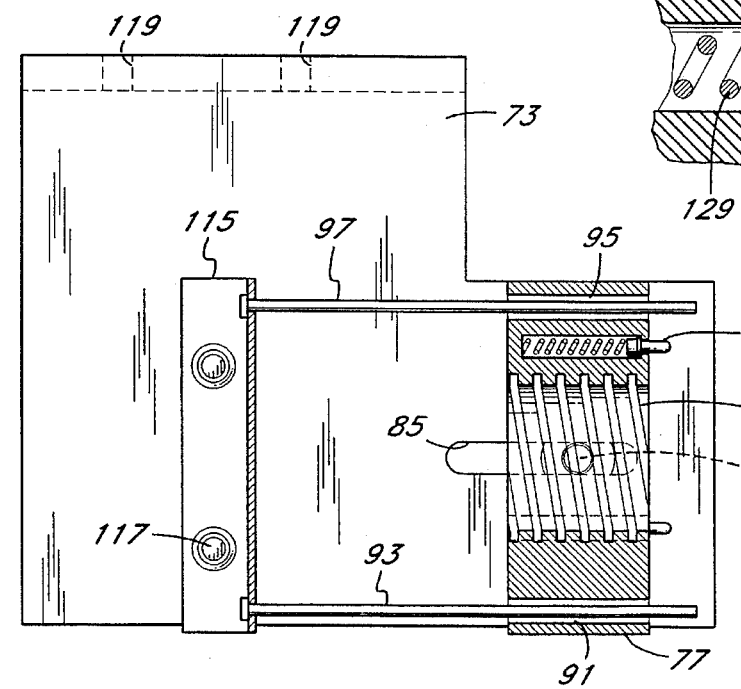
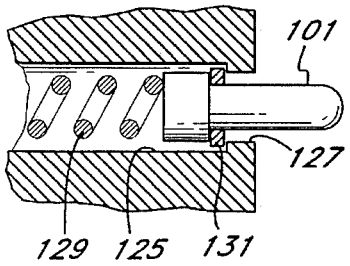
Fig. 5b

HIGH WATTAGE LAMP FERRULE AND SOCKET SYSTEM

This is a continuation of application Ser. No. 08/103,350 which parent application was filed on Aug. 9, 1993, now abandoned.

FIELD OF THE INVENTION

The present invention relates to the field of electrical lighting and more specifically to high wattage, typically up to about 10,000 watts, ferrule and socket assemblies for xenon lamps.

BACKGROUND OF THE INVENTION

Xenon lamps are known for providing extremely high intensity lighting, particularly for stadium, theatrical and film projector applications. Xenon lamps carry xenon gas under high pressure in an elongated glass envelope, usually made of quartz glass. The light given off from the high pressure xenon has a close resemblance to sunlight in terms of the spectral distribution of light given off under normal electrical load.

Inside the glass envelope, a cathode is situated opposite an anode a proper distance to maintain an arc. The cathode is kept small to insure that its temperature will be sufficiently high, at its rated current, to emit the electrons necessary to sustain the arc.

The power supply is typically a direct current power supply including an ignition device. The operating voltage of such lamps is from about 15 volts for lamps of about 75 watts, up to about 65 volts for lamps of about 10,000 watts. Consequently, the current for such lamps, following ohms law, is about 5 amps for a 75 watt lamp and about 153.8 amps for the 10,000 watt lamp.

Although some variations on the configurations of the lamps are known, the higher wattage lamps have required a bolt and nut, cable type connection. With this type of connection, electrician's tools are required to replace the lamps which have failed. In some cases, cable pig tails are provided from metal sleeves used to strengthen the conductor transition into the glass envelope. The cable pig tails may be fitted with lugs having eyelets for the engagement of the lugs using electrically rated bolts. A wrench is needed to ensure good, tight electrical contact. The labor expenditure in changing spent bulbs is therefore significant, requiring specialized tools.

In some of the lower current configurations, the lamps may be fitted with an end portion having a fine threaded end adjacent a knurled nut. The knurled nut is used to rotate the fine threaded end into engagement with a threaded lug at the end of a cable. Currently, the maximum power ratings of lamps which employ such connective structures are on the order of no more than 4000 watts.

One of the reasons that the knurled nut is used with a finely threaded member in the lower current configurations, is the necessity for lamp clearance during installation and removal. The threaded male members may be attached to the female members while the lamp is mounted generally in the position to which it will rest during operation. Since the conductors are located at the opposite ends of the lamp, the current configuration would not permit a xenon lamp, even one of low current, to be screwably mounted like a standard light bulb. A light bulb with two, oppositely oriented threaded ends would not permit a standard light bulb-type socket to be utilized.

What is needed is a configuration which will facilitate the changing and installation of high power lighting, especially xenon lamps. The configuration should include a fitting for the lamp and the electrical conductor to which it is to be connected which will allow for hand mounting of the lamp.

SUMMARY OF THE INVENTION

The present invention includes a ferrule and socket which form a current carrying portion of the lamp. The ferrule and socket are wholly of the same polarity and engage one end of the lamp. The socket is designed to enable the lamp to pivot slightly to enhance the flexibility and ease with which it may be installed and replaced. A mounting bracket enables the lamp, once installed into a block carried by the bracket, to be translated upwardly and downwardly along the axis of the lamp, which, in combination with the slight pivot provided by the bracket, makes the lamp easier to move into a location for connection to an upper conductor. More importantly, the ferrule and socket system of the present invention has been designed to enable such facilitative movements while still being able to handle the higher power ratings, up to and including the 10,000 watt range.

BRIEF DESCRIPTION OF THE DRAWINGS

The present invention, its advantages and structure will be best described with reference to the drawings in which:

FIG. 4 is a side view of the socket assembly of FIG. 2 engaged with the ferrule of FIG. 1 as was shown in FIG. 3;

FIG. 5*a* is a side sectional view of the block of the socket assembly of FIGS. 2–4; and FIG. 5*b* is a detailed sectional view of a plunger assembly mounted in the block shown in FIGS. 2–4 and 5*a*.

DETAILED DESCRIPTION OF THE PREFERRED EMBODIMENT

Figure 1:
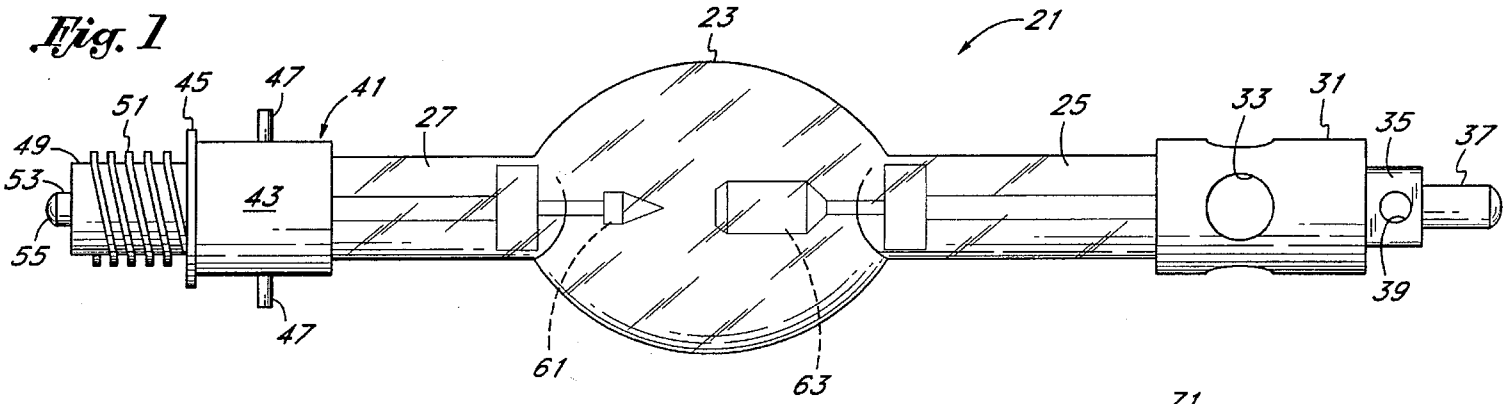
FIG. 1 is a side view of a lamp fitted with the ferrule of the present invention.

The description and operation of the invention will be best described with reference to FIG. 1. FIG. 1 is a side view of a lamp 21 which exhibits an overall geometry similar to that for many xenon lamps currently available. Lamp 21 has an expanded diameter glass mid section 23 and a first cylindrical glass end 25 and a second cylindrical glass end 27 abutting the expanded diameter mid section 23.

First cylindrical glass end 25 abuts a metallic sleeve 31 which rigidly embraces the first cylindrical glass end 25 of the lamp 21. In FIG. 1, a hole 33 is shown in the sleeve 31 which may serve several purposes. Hole 33 may facilitate the introduction of bonding agents used to affix the sleeve 31 to the first cylindrical glass end 25. Sleeve 31 has a concentrically smaller anchor portion 35 extending away from sleeve 31 and first cylindrical glass end 25, and a still smaller plug insert 37 extending away from anchor portion 35, sleeve 31 and first cylindrical glass end 25.

Smaller anchor portion 35 typically has a threaded aperture 39 to facilitate connection to an upper conductor (not shown) in a conventional manner. typically, smaller plug insert 37 operates in conjunction with the smaller anchor portion 35 to provide adequate current transfer area. The end of a cable (not shown) may have a fitting which is matable with the structures supported by the sleeve 31 in a conventional manner, and consist of a wide variety of differing structures necessary to interfit with the lamp 21 at the sleeve 31 end.

The invention herein more directly relates to a ferrule 41 attached to the second cylindrical glass end 27. Ferrule 41 has a straight cylindrical surface 43, having a diameter of about one and a half inches, bounded by a narrow circular land 45 having a diameter of about 1.750 inches. Ferrule 41 also typically has a pair of opposing pins 47. In the preferred embodiment, the pins 47 are about 0.188 inches in diameter and about 0.375 inches long. Pins 47 may be round, cylindrical pins, or rectangular. Pins 47 can assist in the rotation of the ferrule 41 and lamp 21 since it is the most prominent structure extending from the ferrule 41.

Adjacent the narrow circular land 45 is a cylindrical thread surface 49 supporting threads 51. Cylindrical thread surface 49 has a diameter in the preferred embodiment of about 1.016 inches. The threads are preferably 1.25 inch in diameter, 0.2 inch pitch, 0.6 inch lead, ACME-3G. These threads 51 form a 3-start configuration which assists in starting the threaded engagement of the thread surface into a socket (to be shown). The 3-start nature of the threads means that the thread surface will need to be turned less than 120° to start threaded engagement of the lamp 21.

This feature is important, not only in minimizing the time in which the lamp 21 is changed, but also to minimize the handling and stress placed on the lamp 21 during the changing operation. The use of multiple start threads reduces the axial torque impressed upon the lamp 21 during its mounting. In horizontal mounting configurations, it is important that the lamp 21 be supported quickly. Further, in the horizontal mounting configuration, the effect of gravity can act to cause one side of the lamp 21's active elements (to be shown) to wear unevenly. In such a situation, it is desirable to cause the lamp to be axially shifted in its horizontal position to reduce the aforementioned un-evenness of wear.

Shifting the position of the structure holding the lamp is not feasable. The use of a multiple-start thread will allow the number of multiples of thread starts used to adjust the position of the lamp as it is supported. To shift the position of the lamp 21, it need only be unscrewed from its holding structure and moved back a single start from the start from which it was removed. In this manner, a 3-start lamp can assume three positions, a 4-start lamp can assume four positions, and so on. It is contemplated that a plurality of starts may be used in conjuction with lamp 21.

In higher current lamps such as lamp 21, it has been recommended, in a three start configuration, to shift the axial position of the lamp 21 to a new 120° position for each 100 hours of operating time. Other periods of time involving multiple start threads less than or greater than a 3-start may have different time period requirements for good practice.

The threads 51 have a trapezoidal cross section. The trapezoidal cross section provides additional support, holding force, and current transfer area.

Extending away from the cylindrical thread surface 49 at its end, is a reduced diameter cylindrical portion 53 bounded at its most remote end by a Curved head 55. Curved head 55 may have a diameter less than the diameter of the reduced diameter cylindrical portion 53 which has a diameter in a preferred embodiment of about 0.375 inches.

Also shown within the expanded diameter glass mid section 23 is a relatively smaller cathode 61 which is electrically connected to the ferrule 41, and a relatively larger anode 63 which is electrically connected to the metallic sleeve 31.

Figure 2:
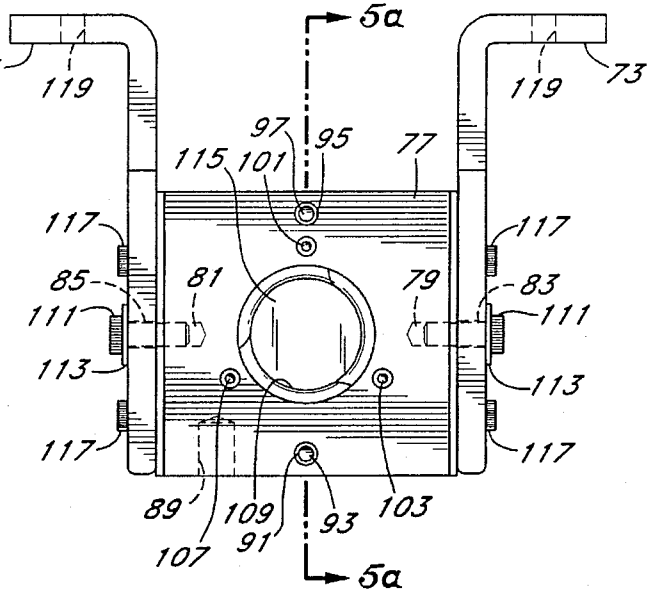
FIG. 2 is a top view of a socket assembly engageable with the lamp and ferrule of FIG. 1.

Referring to FIG. 2, a top view of a socket assembly 71 is shown. The mounting portion of the socket assembly 71 includes a right angled bracket 73 and a left angled bracket 75 and a somewhat pivotally mounted block 77. Block 77 includes a right side tap 79, and a left side tap 81, both shown in dashed line format. Tap 79 is in alignment with a slot 83 in right angled bracket 73, while tap 81 is in alignment with a slot 85 in left angled bracket 75. These alignments permit the insertion of a pair of bolts (to be discussed later) which enable the block 77 to be somewhat pivotally supported by the right and left angled brackets 73 and 75.

Block 77 also includes a larger frontal tap 89, also shown in dashed line format, to permit attachment of a conductor cable (also not shown). Block 77 is preferably made of a single block of machined brass and finished in nickel plate. Right and left angled brackets 73 and 75, however, are made of an insulative material, such as a composite or fiberglass. The right and left angled brackets 73 and 75, will be bolted directly to a support structure (not shown), and would ground one terminal of the lamp 21 if they were made of a conductive material.

As will be shown, the ability of the block 77 to pivot is limited. Block 77 also contains a forward vertical through-bore 91 loosely carrying a forward rod 93, and a rearward vertical through-bore 95 loosely carrying a rearward rod 97. The rods 93 and 97 are supported from a plate (not yet clearly shown), and limit the amount of tilt to which the block 77 can be subjected.

Also shown in FIG. 2 are the ends of a set of three spring plungers 101, 103, and 107 surrounding a central threaded bore 109. Central threaded bore 109 has threads which match the threads on the ferrule 41, which in the instant case are 3-start Acme threads. The narrow circular land 45 of the lamp 21 is designed to overlie the spring plungers 101, 103, and 107 when the ferrule 41 is threadably inserted into the block 77. The three spring plungers 101, 103, and 107 are designed to load the threaded interface of the ferrule 41 with respect to the block 77 upon final seating to ensure that the threads will be continuously loaded to maintain high thread area contact and thus maintain the high current connection between the ferrule 41 and the block 77.

Figure 3:
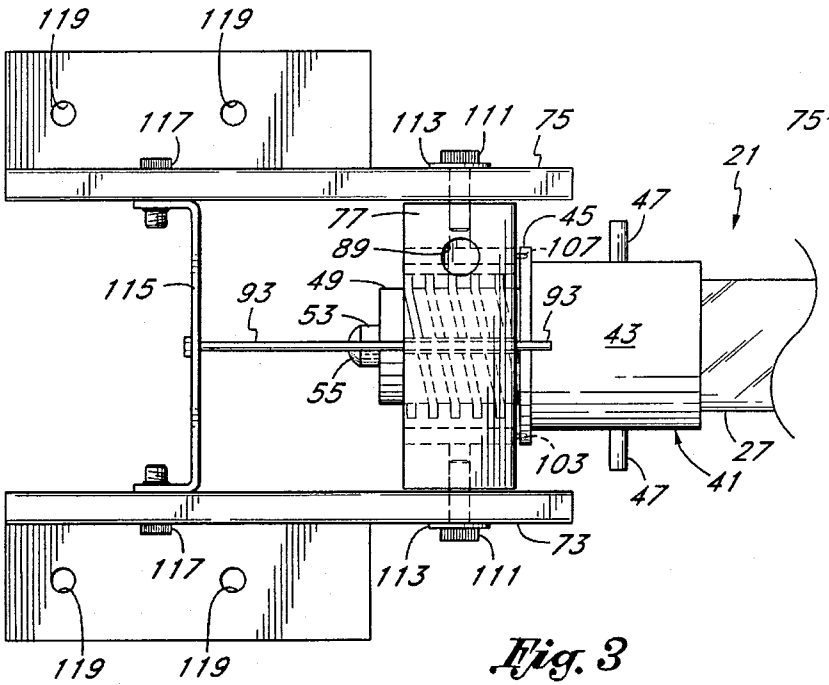
FIG. 3 is a front view of the socket assembly of FIG. 2 engaged with the ferrule of FIG. 1.

Referring to FIG. 3, a front-view of the socket assembly 71 is shown with the ferrule 41 and lamp 21 attached. Only enough of the lamp 21 is shown to provide orientation. Note the details of engagement of ferrule 41 with block 77. The cylindrical thread surface 49, reduced diameter cylindrical portion 53 and curved head 55 extend slightly below block 77. The electrical contact between the other portions of ferrule 41 and block 77 are sufficient without the need for contact directly upon the bottom of cylindrical thread surface 49, reduced diameter cylindrical portion 53 or curved head 55.

Note the engagement shown of the spring plungers 103 and 107 against the narrow circular land 45. In FIG. 3, the main bolts 111 are shown,.each engaging a washer 113. Main bolts 111 hold the block 77 in place, but, as will be shown, allow the block to translate vertically with respect to the right and left angled brackets 73 and 75. Such translation will allow the block 77 to move with respect to the rods 93 and 97 which remain fixed. Rods 93 and 97 are supported by a plate 115 which is bolted to the right and left angled brackets 73 and 75 with four bolts 117, two of which are shown in FIG. 3. The other two bolts 117 are shown to the rear of the two bolts shown in FIG. 3.

Preferably, the rods 93 and 97 may have threaded ends and be threaded into threaded apertures in the plate 115. Rods 93 and 97 may be affixed by any other method, such as punching, welding, or the like. Since it is the right and left angled brackets 79 and 75 which provide the insulation, it is acceptable for the plate 115 to be electrified since it is set sufficiently away from the structure which supports the socket assembly 71.

Right and left angled brackets 73 and 75 are provided with mounting apertures 119 to facilitate the mounting of the socket assembly 71 to a surface. Once securely mounted, a conductor having a threaded end can be mounted into the frontal tap 89 carried by the block 77. A frontal tap 89 having a diameter of about three eighths of an inch should be sufficient, along with block 77 for carrying high current to a lamp 21, on the order of at least 200 amps of current. Next, the lamp 21 can be moved longitudinally, along with the block 77, to reach any type of upper fitting to which the sleeve 31, shown in FIG. 1, needs to be attached. Typically such a fitting may involve an over fitting sleeve with bolt attachment to fit within threaded aperture 39. Moreover, the ability of the socket assembly 71 to provide translation of the lamp 21 enables a more exacting adjustment of the lamp 21 to insure that the point of maximum brightness of the lamp 21 is kept at the focal point of any reflector system with which the lamp 21 is used.

The ability to adjust the lamp 21 longitudinally is best shown with respect to FIG. 4. FIG. 4 emphasizes the left angled bracket 75. As can be seen, bolt 111 engages the block 77 not through an aperture, but through a slot 85. Note the distance separation of the block 77 away from the surface of the socket assembly 71 having the mounting apertures 119. Such separation lessens the probability of contact of the conductive structures, such as block 77 and plate 115 with any structures on the surface to which socket assembly 71 may be attached.

Referring to FIG. 5*a* and 5*b*, a section taken along line 5–5 of FIG. 2 illustrates the threads of the central threaded bore 109. Also illustrated is the spring plunger 101 which was shown in FIG. 2 as located at the rear of the block 77. Spring plunger 101 is within a blind bore 125 having a slightly smaller opening 127. The plunger 101 is of limited length, and urged outwardly by a spring 129. Typically the plunger 101 may be engaged at its lower end by a locking ring 131 which may be able to be moved past the slightly smaller opening 127 and expanded to be larger than and to engage the slightly smaller opening 127. Alternatively, the plunger 101 may have a lower rim which may be cut to be snap fit pat the slightly smaller opening 127.

While the present invention has been described in terms of a high current xenon lamp ferrule and socket, one skilled in the art will realize that the structure and techniques of the present invention can be applied to many electrical connections and appliances. The present invention may be applied in any situation where a relatively large current is required and where a connector which is adjustable and which facilitates rapid installation and lamp replacement is needed.

Although the invention has been derived with reference to particular illustrative embodiments thereof, many changes and modifications of the invention may become apparent to those skilled in the art without departing from the spirit and scope of the invention. Therefore, included within the patent warranted hereon are all such changes and modifications as may reasonably and properly be included within the scope of this contribution to the art.

What is claimed:

1. A high current ferrule connector for a lamp comprising:

a ferrule having a straight cylindrical surface for engaging a second cylindrical glass end of a lamp, a circular land continuously abutting and adjacent said straight cylindrical surface and having a common central longitudinal axis with said straight cylindrical surface, and a cylindrical threaded surface adjacent said circular land and having a diameter smaller than that of the circular land and carrying threads thereon.

2. The high current ferrule connector recited in claim 1 wherein said straight cylindrical surface carries at least a pair of outwardly directed pins continuous with said straight cylindrical surface.

3. The high current ferrule connector recited in claim 1 wherein said threads carried by said cylindrical threaded surface have a trapezoidal cross section.

4. A high current lamp, including the high current ferrule connector of claim 1, and further comprising:

a glass envelope having an expanded diameter mid section bounded by a first cylindrical glass end and having a second cylindrical glass end engaging said straight cylindrical surface of said ferrule;

a conductive sleeve engaging said first cylindrical glass end of said glass envelope;

a cathode, within said expanded diameter mid section of said glass envelope and electrically connected through said second cylindrical glass end of said glass envelope to said ferrule; and an anode, within said expanded diameter mid section of said glass envelope and electrically connected through said first cylindrical glass end of said glass envelope to said sleeve.

5. The high current ferrule connector recited in claim 1 wherein said threads are multiple-start threads.

6. The high current ferrule connector recited in claim 5 wherein said multiple-start threads are 3-start threads.

7. The high current ferrule connector for a lamp as recited in claim 1 wherein said cylindrical threaded surface contains three start threads to facilitate a change in the position of said ferrule between one of three positions associated with said three start threads.

8. The high current ferrule connector for a lamp as recited in claim 1 wherein said ferrule has a reduced diameter cylindrical portion bounded at its most remote end by a curved head to facilitate electrical conductive connection of said ferrule.

9. The high current ferrule connector for a lamp as recited in claim 1 wherein said straight cylindrical surface, said circular land, and said cylindrical threaded surface are conductive.

10. The high current ferrule connector for a lamp as recited in claim 7 wherein said cylindrical threaded surface contains threads having a trapezoidal cross section.

11. The high current ferrule connector for a lamp as recited in claim 2 wherein said outwardly directed pins are oppositely directed and share a common axis.

12. The high current lamp as recited in claim 4 wherein said cylindrical threaded surface includes three start threads to facilitate a change in the position of said high current lamp between one of three positions associated with said three start threads.

13. The high current lamp as recited in claim 4 wherein said ferrule has a reduced diameter cylindrical portion bounded at its most remote end by a curved head to facilitate electrical conductive connection of said ferrule.

14. The high current lamp as recited in claim 12 wherein said cylindrical threaded surface contains threads having a trapezoidal cross section.

15. The high current lamp recited in claim 4 wherein said straight cylindrical surface carries at least a pair of outwardly directed pins continuous with said straight cylindrical surface.

16. The high current lamp as recited in claim 15 wherein said outwardly directed pins are oppositely directed and share a common axis.

17. The high current lamp as recited in claim 4 wherein said straight cylindrical surface has a diameter greater than that of said cylindrical threaded surface.

18. A high current socket connector for a lamp comprising:

a conductive block having a central threaded bore for engagement with a ferrule, said block having a pair of outwardly disposed apertures for supporting said block, said block also having means for forming an electrical connection to said block; and bracket means for supporting said block using said outwardly disposed apertures and for insulating said block with respect to a mounting surface, and wherein said bracket means is also for enabling said block to translationally move along a longitudinal axis of said central threaded bore.

19. The high current socket connector recited in claim 18 wherein said means for forming an electrical connection to said block further comprises a threaded tap for insertion of a threaded electrical connector.

20. The high current socket connector recited in claim 18 wherein said means for forming an electrical connection to said block and said block are rated to carry at least 200 amps of current.

21. The high current socket connector recited in claim 18 further comprising at least one spring plunger assembly further comprising:

a plunger partially carried within a plunger bore defined by said block and having a blind end and a smaller diameter open end, said plunger having an upper end for engaging a portion of a ferrule to urge it away from said block, and a lower end, said plunger movable along an axis of said plunger bore limited by said smaller diameter open end; and a spring carried within said plunger bore and having a first end engaging said blind end of said plunger bore and a second end engaging said lower end of said plunger.

22. The high current socket connector recited in claim 21 further comprising three spring plunger assemblies closely adjacent to and equally spaced about said central threaded bore.

23. The high current socket connector recited in claim 21 further comprising a lock ring engaging the smaller diameter open end of said plunger bore and said plunger to limit the movement of said plunger out of said plunger bore.

24. The high current socket connector recited in claim 18 wherein said pair of outwardly disposed apertures for supporting said block are threaded and wherein said bracket means further comprises:

a first insulated bracket including a support aperture;

a second insulated bracket including a support aperture;

central support means, connected to said first insulated bracket and said second insulated bracket, for supporting said first insulated bracket relative to said second insulated bracket;

a first bolt extending through said support aperture of said first insulated bracket and into one of said pair of threaded outwardly disposed apertures carried by said block; and a second bolt extending through said support aperture of said second insulated bracket and into the other of said pair of threaded outwardly disposed apertures carried by said block.

25. The high current socket connector recited in claim 24 wherein said support apertures of said first and second brackets are elongated to form slots to enable said block to be translationally moved along a longitudinal axis of said central threaded bore.

26. The high current socket connector recited in claim 24 wherein said central support means further comprises a plate having a central portion and a pair of opposing, parallel side portions, one side portion attached to said first insulated bracket and the other side portion attached to said second insulated bracket.

27. The high current socket connector recited in claim 24 wherein said first insulated bracket further comprises a first portion carrying said support aperture of said first insulated bracket and a second portion for engaging said first insulated bracket to a surface and wherein said second insulated bracket further comprises a first portion carrying said support aperture of said second insulated bracket and a second portion for engaging said second insulated bracket to a surface.

28. The high current socket connector recited in claim, 27 wherein said second portion of said first insulated bracket and said second portion of said second insulated bracket lies in the same plane.

29. The high current socket connector recited in claim 24 wherein said block includes a first vertical through-bore and a second vertical through-bore and further comprising:

a first rod supported by said central support means and extending through said first vertical through-bore; and a second rod supported by said central support means and extending through said second vertical through-bore, said first and said second rods acting to guide said block as it is moved along the longitudinal axes of said central threaded bore.

30. The high current socket connector recited in claim 29 wherein said first and said second vertical through-bores are sufficiently larger than said first and said second rods to enable said block to pivot slightly about said first and second bolts.

31. A high current lamp system comprising: a high current lamp further comprising:

a glass envelope having an expanded diameter mid section bounded by a first cylindrical glass end and a second cylindrical glass end;

a ferrule having a straight cylindrical surface engaging said second cylindrical glass end of a lamp, a circular land continuously abutting and adjacent said straight cylindrical surface, said land and said cylindrical surface concentric with each other, and a cylindrical threaded surface adjacent said circular land and having a diameter smaller than that of said circular land and carrying threads thereon;

a conductive sleeve engaging said first cylindrical glass end of said glass envelope;

a cathode, within said expanded diameter mid section of said glass envelope and electrically connected through said second cylindrical glass end of said glass envelope to said ferrule; and an anode, within said expanded diameter mid section of said glass envelope and electrically connected through said first cylindrical glass end of said glass envelope to said sleeve; and a socket assembly further comprising:

a high current conductive block having a central threaded bore for engagement with said ferrule, and having means for forming an electrical connection to said block; and bracket means, for insulatively supporting said block with respect to a mounting surface.

32. The high current lamp system recited in claim 31 wherein said bracket means is also for enabling said block to translationally move along a longitudinal axis of said central threaded bore.

33. A high current lamp system comprising:

a ferrule having a first open end for engaging a second cylindrical glass end of a lamp and a second end, said ferrule including a straight cylindrical surface adjacent said first end of said ferrule, and a cylindrical threaded surface adjacent said second end of said ferrule and having a diameter less than that of said straight cylindrical surface and a circular land, the circular land provided between said threaded surface and said straight cylindrical surface, the circular land having a common central longitudinal axis with the straight cylindrical surface;

a glass envelope having an expanded diameter mid section bounded by a first cylindrical glass end and having a second cylindrical glass end engaging said first open end of said ferrule;

a conductive sleeve engaging said first cylindrical glass end of said glass envelope;

a cathode, within said expanded diameter mid section of said glass envelope and electrically connected through said second cylindrical glass end of said glass envelope to said ferrule; and an anode, within said expanded diameter mid section of said glass envelope and electrically connected through said first cylindrical glass end of said glass envelope to said sleeve.

34. The high current lamp system as recited in claim 33 wherein said cylindrical threaded surface includes three start threads to facilitate a change in the position of said lamp between one of three positions associated with said three start threads.

35. The high current lamp system as recited in claim 33 wherein said ferrule has a reduced diameter cylindrical portion bounded at said second end of said ferrule by a curved head to facilitate electrical conductive connection of said ferrule.

36. The high current lamp system as recited in claim 34 wherein said three start threads have a trapezoidal cross section.

37. The high current lamp system recited in claim 33 wherein said straight cylindrical surface carries at least a pair of outwardly directed pins continuous with said straight cylindrical surface.

* * * * *